US007761037B2

(12) United States Patent
Ohashi et al.

(10) Patent No.: US 7,761,037 B2
(45) Date of Patent: Jul. 20, 2010

(54) IMAGE FORMATION APPARATUS THAT REPLENISHES DEVELOPER BASED ON DETECTED HEIGHT OF DEVELOPER AND ROTATING SPEED OF DEVELOPER CARRIER

(75) Inventors: Kazuyoshi Ohashi, Matsumoto (JP); Katsumi Okamoto, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 381 days.

(21) Appl. No.: 12/039,657

(22) Filed: Feb. 28, 2008

(65) Prior Publication Data

US 2008/0212985 A1 Sep. 4, 2008

(30) Foreign Application Priority Data

Mar. 2, 2007 (JP) ..... 2007-052857

(51) Int. Cl.
*G03G 15/08* (2006.01)

(52) U.S. Cl. ..... 399/258; 399/236; 399/244

(58) Field of Classification Search ..... 399/27, 399/120, 158, 260, 244, 236
See application file for complete search history.

(56) References Cited

U.S. PATENT DOCUMENTS 5,430,532 A * 7/1995 Ueda et al. ..... 399/263
5,526,100 A * 6/1996 Misago et al. ..... 399/29
2005/0117919 A1* 6/2005 Ito et al. ..... 399/27
2005/0265738 A1* 12/2005 Ogata ..... 399/27
2006/0233560 A1* 10/2006 Harada et al. ..... 399/27

FOREIGN PATENT DOCUMENTS

| | | |
|---|---|---|
| JP | 05-204244 | 8/1993 |
| JP | 05-265325 | 10/1993 |
| JP | 06-059575 | 3/1994 |
| JP | 2002-214894 | 7/2002 |
| JP | 2003-255688 | 9/2003 |

* cited by examiner

*Primary Examiner*—David M Gray
*Assistant Examiner*—G. M. Hyder
(74) *Attorney, Agent, or Firm*—Hogan Lovells US LLP

(57) ABSTRACT

An image formation apparatus includes a containing section that contains a developer and that has an opening at which a developer carrier is exposed. The developer carrier rotates at a faster first speed or a slower second speed. When a detected height of developer in the containing section is at a replenishment start level and the developer carrier is rotating at the first speed, a replenishing member replenishes developer until the height of the developer reaches a replenishment end level. When the detected height of developer is at the replenishment start level and the developer carrier is rotating at the second speed, the developer is replenished by a predetermined amount.

7 Claims, 8 Drawing Sheets

| PAPER TYPE | SPEED MODE | ROTATION SPEED OF DEVELOPMENT ROLLER |
|---|---|---|
| STANDARD PAPER | HIGH-SPEED MODE (FIRST SPEED MODE) | FASTER |
| OHP-SHEET PAPER THICK PAPER | LOW-SPEED MODE (SECOND SPEED MODE) | SLOWER |

IMAGE FORMATION APPARATUS THAT REPLENISHES DEVELOPER BASED ON DETECTED HEIGHT OF DEVELOPER AND ROTATING SPEED OF DEVELOPER CARRIER

BACKGROUND

1. Technical Field

The present invention relates to an image formation apparatus and an image formation system.

2. Related Art

In the technical field to which the present invention pertains, an image formation apparatus such as a laser beam printer or the like is widely known. In a typical configuration thereof, an image formation apparatus of the related art has a containing section and a developer carrier; in such a typical configuration, the containing section, which has an opening, contains a developer; the developer carrier is exposed at the opening; the developer carrier is configured to carry a developer; and the developer carrier is configured so that it can rotate. Having such a containing section and a developer carrier, an image formation apparatus of the related art is configured so that the developer carrier thereof develops a latent image that is formed on an image carrier by means of a developer that is contained in the containing section.

In addition to the above-described constituent elements, in order to guarantee that the containing section contains a sufficient amount of a developer, the image formation apparatus of the related art further includes a replenishing member that replenishes a developer into the containing section; and a detecting member that detects whether the height of a developer that is contained in the containing section is at a replenishment start level at which replenishment performed by the replenishing member should be started or not and further detects whether the height of a developer that is contained in the containing section is at a replenishment end level at which replenishment performed by the replenishing member should be ended or not. Having such a configuration, for example, the image formation apparatus of the related art starts the replenishment of a developer that is performed by the replenishing member at the time when the detecting member detects that the height of the developer that is contained in the containing section is at the replenishment start level and ends the replenishment of the developer that is performed by the replenishing member at the time when the detecting member detects that the height of the developer that is contained in the containing section is at the replenishment end level. By this means, the image formation apparatus of the related art ensures that a sufficient amount of a developer is contained in the containing section while further ensuring that the amount thereof never becomes excessive.

In the configuration of the image formation apparatus of the related art, the rotation speed of the developer carrier described above is not constant; that is, the rotation speeds of the developer carrier differ from each other depending on predetermined speed modes. The developer carrier rotates on the basis of either a first speed mode or a second speed mode so as to develop a latent image that is formed on an image carrier, where the first speed mode has a faster (i.e., greater) speed of rotation of the developer carrier, and the second speed mode has a slower (i.e., less) speed of rotation of the developer carrier. In the configuration of the image formation apparatus of the related art, regardless of the speed modes, the replenishing member replenishes a developer into the containing section until the detecting member detects that the height of the developer that is contained in the containing section is at the replenishment end level at which the replenishment performed by the replenishing member should be ended. The configuration of the image formation apparatus of the related art is described in Japanese Patent No. 3,681,642 and JP-A-6-59575.

As the developer carrier, which is provided in such a manner that it is partially exposed at the opening, rotates, air enters the containing section via the opening. Depending on the rotation speed of the developer carrier, the amount of air that enters the containing section varies from one to another. Specifically, when the developer carrier rotates in the first speed mode, the amount of air that enters the containing section via the opening because of air entrainment that is attributable to the rotation of the developer carrier is relatively large. On the other hand, when the developer carrier rotates in the second speed mode, the amount of air that enters the containing section via the opening because of air entrainment that is attributable to the rotation of the developer carrier is relatively small.

For this reason, the amount of air that is entrained when the developer carrier rotates in the second speed mode at the time of the replenishing of the developer on the condition that the developer is replenished until the detecting member detects that the height of the developer that is retained in the containing section has reached the replenishment end level is smaller in comparison with the amount of air that is entrained when the developer carrier rotates in the first speed mode at the time of the replenishing of the developer on the same condition as above, that is, on the condition that the developer is replenished until the detecting member detects that the height of the developer that is retained in the containing section has reached the replenishment end level. Accordingly, the amount of air that is contained in the containing section when the developer carrier rotates in the second speed mode at the time of the replenishing of the developer is smaller in comparison with the amount of air that is contained in the containing section when the developer carrier rotates in the first speed mode at the time of the replenishing of the developer. That is, the density of the developer that is contained in the containing section when the developer carrier rotates in the second speed mode at the time of the replenishing of the developer is greater in comparison with the density of the developer that is contained in the containing section when the developer carrier rotates in the first speed mode at the time of the replenishing of the developer. As a result thereof, the amount of the developer that is contained in the containing section when the developer carrier rotates in the second speed mode at the time of the replenishing of the developer is larger in comparison with the amount of the developer that is contained in the containing section when the developer carrier rotates in the first speed mode at the time of the replenishing of the developer.

Then, if the rotation of the developer carrier enters the first speed mode for the purpose of developing a latent image after that the amount of the developer that is contained in the containing section has increased (become relatively large) due to the replenishing of the developer performed when the developer carrier rotates in the second speed mode, air further enters the containing section via the opening because of air entrainment that is attributable to the rotation of the developer carrier with an increased speed, which results in a decrease in the density of the developer. As a result thereof, there is an adverse possibility that the height of the developer that is retained in the containing section could go over the replenishment end level at which the replenishing of the developer should be ended, which could cause the leakage of the developer out of the containing section.

SUMMARY

An advantage of some aspects of the invention is to command the replenishing member to replenish the developer in such a manner that the developer never leaks out of the containing section even under an assumption that the rotation speeds of the developer carrier differ from each other (or one another) depending on speed modes.

In order to address the above-identified problem without any limitation thereto, the invention provides, as the essence thereof, an image formation apparatus that comprises: a containing section that contains a developer, the containing section having an opening; a developer carrier that is exposed at the opening and carries a developer, the developer carrier being capable of rotating, the developer carrier rotating on the basis of either a first speed mode or a second speed mode so as to develop a latent image that is formed on an image carrier, the first speed mode having a faster speed of rotation of the developer carrier, the second speed mode having a slower speed of rotation of the developer carrier; a replenishing member that replenishes a developer into the containing section; a detecting member that detects whether the height of a developer that is contained in the containing section is at a replenishment start level at which replenishment performed by the replenishing member should be started or not and further detects whether the height of a developer that is contained in the containing section is at a replenishment end level at which replenishment performed by the replenishing member should be ended or not; and a controlling section that controls the replenishment of a developer that is performed by the replenishing member, the controlling section commanding the replenishing member to replenish a developer until the detecting member detects that the height of the developer that is contained in the containing section is at the replenishment end level if the detecting member detects that the height of the developer that is contained in the containing section is at the replenishment start level when the developer carrier that rotates on the basis of the first speed mode develops the latent image, whereas the controlling section commanding the replenishing member to replenish a developer by a predetermined amount if the detecting member detects that the height of the developer that is contained in the containing section is at the replenishment start level when the developer carrier that rotates on the basis of the second speed mode develops the latent image.

Other features and advantages offered by the invention will be fully understood by referring to the following detailed description in conjunction with the accompanied drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
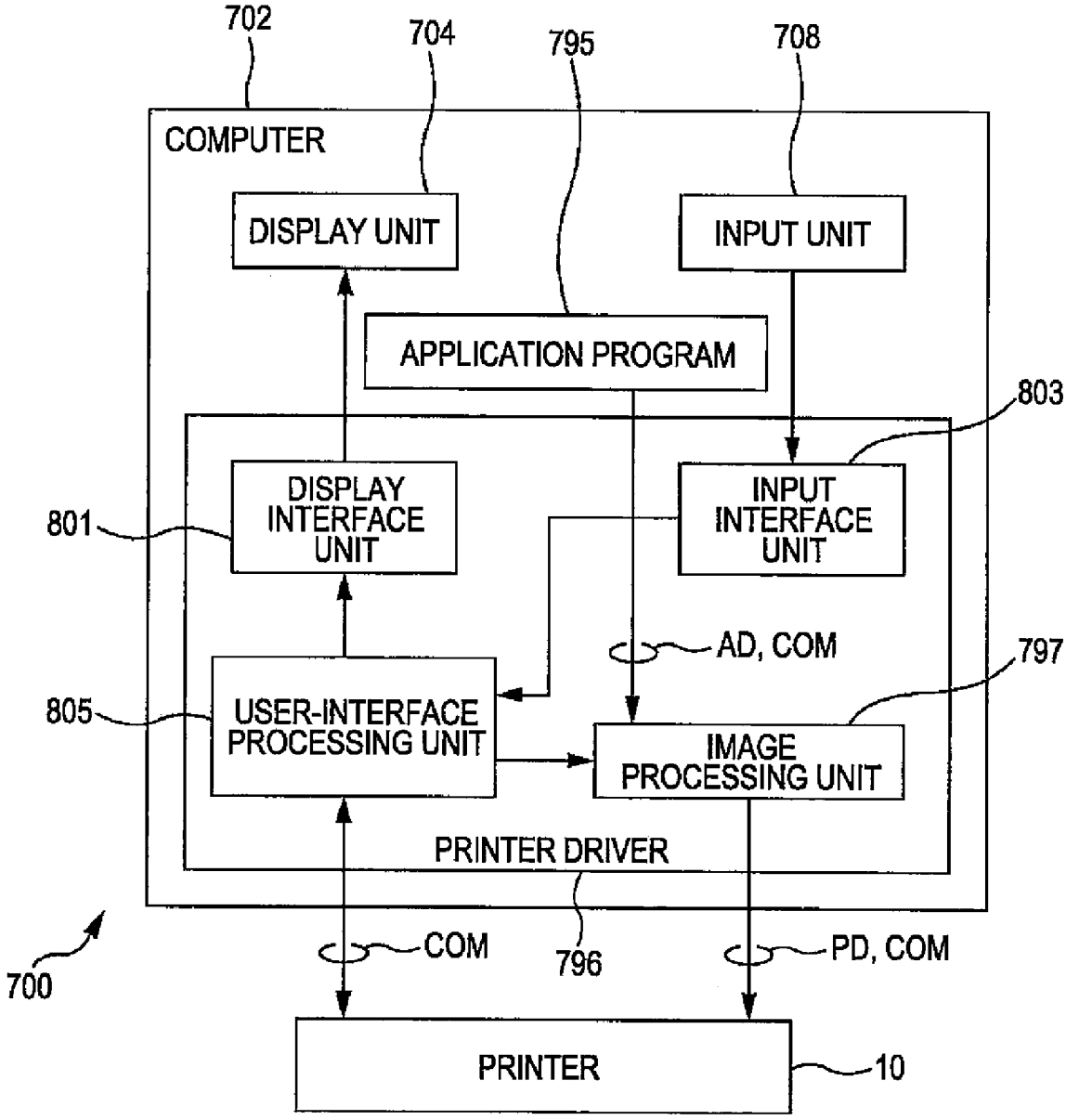
FIG. 1 is a block diagram that schematically illustrates an example of the partial configuration of an image formation system 700 according to an exemplary embodiment of the invention.

Referring to the following detailed description in conjunction with the accompanied drawings, one will fully understand at least the following inventive concept of the invention.

As a first aspect thereof, the invention provides an image formation apparatus comprising: a containing section that contains a developer, the containing section having an opening; a developer carrier that is exposed at the opening and carries a developer, the developer carrier being capable of rotating, the developer carrier rotating on the basis of either a first speed mode or a second speed mode so as to develop a latent image that is formed on an image carrier, the first speed mode having a faster speed of rotation of the developer carrier, the second speed mode having a slower speed of rotation of the developer carrier; a replenishing member that replenishes a developer into the containing section; a detecting member that detects whether the height of a developer that is contained in the containing section is at a replenishment start level at which replenishment performed by the replenishing member should be started or not and further detects whether the height of a developer that is contained in the containing section is at a replenishment end level at which replenishment performed by the replenishing member should be ended or not; and a controlling section that controls the replenishment of a developer that is performed by the replenishing member, the controlling section commanding the replenishing member to replenish a developer until the detecting member detects that the height of the developer that is contained in the containing section is at the replenishment end level if the detecting member detects that the height of the developer that is contained in the containing section is at the replenishment start level when the developer carrier that rotates on the basis of the first speed mode develops the latent image, whereas the controlling section commanding the replenishing member to replenish a developer by a predetermined amount if the detecting member detects that the height of the developer that is contained in the containing section is at the replenishment start level when the developer carrier that rotates on the basis of the second speed mode develops the latent image. Because an image formation apparatus according to the first aspect of the invention has a unique configuration described above, the controlling section can command the replenishing member to replenish the developer in such a manner that the developer never leaks out of the containing section even under an assumption that the rotation speeds of the developer carrier differ from each other (or one another) depending on speed modes.

In the configuration of the image formation apparatus according to the first aspect of the invention, it is preferable that the controlling section should command the developer carrier to rotate in the first speed mode without performing the development of a latent image after the developer carrier rotating in the second speed mode has finished latent-image development processing. With such a preferred configuration, it is possible to check the height of the developer during the operation under the first speed mode.

In the image formation apparatus having such a preferred configuration, it is further preferable that, if the detecting member detects that the height of the developer falls short of the replenishment end level even after the developer carrier has rotated in the first speed mode without performing the development of a latent image under the command of the controlling section, the controlling section should command the replenishing member to replenish the developer until the detecting member detects that the height of the developer that is contained in the containing section has reached the replenishment end level. With such a preferred configuration, it is possible to correct the height of the developer so as to ensure that the "water" level thereof is at the replenishment end height even when the developer is replenished by the predetermined amount.

In the configuration of the image formation apparatus according to the first aspect of the invention, it is preferable that the predetermined amount should be smaller than the amount of the developer that is replenished by the replenishing member from the start of the replenishment till the end thereof, where the replenishment is started when the detecting member detects that the height of the developer that is contained in the containing section is at the replenishment start level after the remaining amount of the developer that is contained in the containing section has decreased because the developer had been used, for developing a latent image, by the developer carrier rotating in the second speed mode, and the replenishment is ended when the detecting member detects that the height of the developer that is contained in the containing section is at the replenishment end level. With such a preferred configuration, it is possible to avoid the leakage of the developer out of the containing section after the replenishment of the developer.

In the configuration of the image formation apparatus according to the first aspect of the invention, it is preferable that the controlling section should acquire information on the consumption amount of the developer that is used by the developer carrier for latent-image development (i.e., development of the latent image); if the controlling section judges that the consumption amount of the developer has reached a predetermined value, the controlling section should command the detecting member to detect whether or not the height of the developer that is contained in the containing section lies at the replenishment start level at which the replenishing member should start the replenishing of the developer; and the controlling section should command the replenishing member to start the replenishment of the developer if, as the result of such detection, it is judged that the height of the developer that is contained in the containing section lies at the replenishment start level at which the replenishing member should start the replenishing of the developer. With such a preferred configuration, it is possible to reduce the amount/consumption of power supplied to the detecting member.

In the configuration of the image formation apparatus according to the first aspect of the invention, it is preferable that the image carrier, which is provided in a rotatable manner, should rotate with a faster speed when the developer carrier rotates in the first speed mode for the development of the latent image, whereas the image carrier should rotate with a slower speed when the developer carrier rotates in the second speed mode for the development of the latent image.

As a second aspect thereof, the invention provides an image formation system comprising: a computer; and an image formation apparatus that can be connected to the computer, the image formation apparatus of the image formation system including: a containing section that contains a developer, the containing section having an opening; a developer carrier that is exposed at the opening and carries a developer, the developer carrier being capable of rotating, the developer carrier rotating on the basis of either a first speed mode or a second speed mode so as to develop a latent image that is formed on an image carrier, the first speed mode having a faster speed of rotation of the developer carrier, the second speed mode having a slower speed of rotation of the developer carrier; a replenishing member that replenishes a developer into the containing section; a detecting member that detects whether the height of a developer that is contained in the containing section is at a replenishment start level at which replenishment performed by the replenishing member should be started or not and further detects whether the height of a developer that is contained in the containing section is at a replenishment end level at which replenishment performed by the replenishing member should be ended or not; and a controlling section that controls the replenishment of a developer that is performed by the replenishing member, the controlling section commanding the replenishing member to replenish a developer until the detecting member detects that the height of the developer that is contained in the containing section is at the replenishment end level if the detecting member detects that the height of the developer that is contained in the containing section is at the replenishment start level when the developer carrier that rotates on the basis of the first speed mode develops the latent image, whereas the controlling section commanding the replenishing member to replenish a developer by a predetermined amount if the detecting member detects that the height of the developer that is contained in the containing section is at the replenishment start level when the developer carrier that rotates on the basis of the second speed mode develops the latent image.

Because an image formation system according to the second aspect of the invention has a unique configuration described above, the controlling section can command the replenishing member to replenish the developer in such a manner that the developer never leaks out of the containing section even under an assumption that the rotation speeds of the developer carrier differ from each other (or one another) depending on speed modes.

Example of General Configuration of Image Formation System

First of all, with reference to FIG. 1, an example of the general configuration of an image formation system 700 according to an exemplary embodiment of the invention is explained below. FIG. 1 is a block diagram that schematically illustrates an example of the partial configuration of the image formation system 700 according to the present embodiment of the invention. The image formation system 700 is provided with a printer 10 and a computer 702. The printer 10 is an example of an "image formation apparatus" according to the invention without any limitation thereto. The computer 702 is configured in such a manner that it can be electrically connected to the printer 10. A more detailed explanation of the printer 10 will be given later.

The computer 702 is provided with a display unit 704 such as a display device or the like, an input unit 708 such as a keyboard or the like, and an internal memory such as a RAM or the like. Note that the internal memory is not illustrated in FIG. 1. In addition to these hardware components described above, the computer 702 has an operating system, an application program 795 that runs under the control of the operating system, and a printer driver 796.

The application program 795 of the computer 702 dictates the printer 10 to perform image-formation processing. When an image-formation execution command is issued from the application program 795, an image data AD that is held on the application program 795 is sent to the printer driver 796 together with a variety of control signals COM. The printer driver 796 has an image processing unit (image processor) 797, a display interface unit 801, an input interface unit 803, and a user-interface processing unit 805.

The image processor 797 of the printer driver 796 receives the image data AD that is from the application program 795, where the image data AD is one that can be interpreted by the application program 795. Then, the image processor 797 converts the received image data AD into a printer-readable image data PD, which can be interpreted by the printer 10. Thereafter, the image processor 797 sends the converted image data PD together with the variety of control signals COM to the printer 10. The display interface unit 801 has a function to display a variety of user-interface windows, which are to be used for making image-formation setting and the like, on the display unit 704. The input interface unit 803 has a function to receive input data (input information) that is inputted on a user-interface window by a user by means of the input unit 708. The user-interface processing unit 805 is responsible for interfacing between the input interface unit 803 (not limited thereto) and the printer 10. For example, the user-interface processing unit 805 receives the input information from the input interface unit 803 and then interprets the received input information. In addition, the user-interface processing unit 805 sends a variety of control signals COM to the printer 10 and the image processor 797. Moreover, the user-interface processing unit 805 interprets a variety of control signals COM that are received from the printer 10 and then sends display-related information to the display interface unit 801.

Exemplary Configuration and Operation of Image Formation Apparatus

Figure 2:
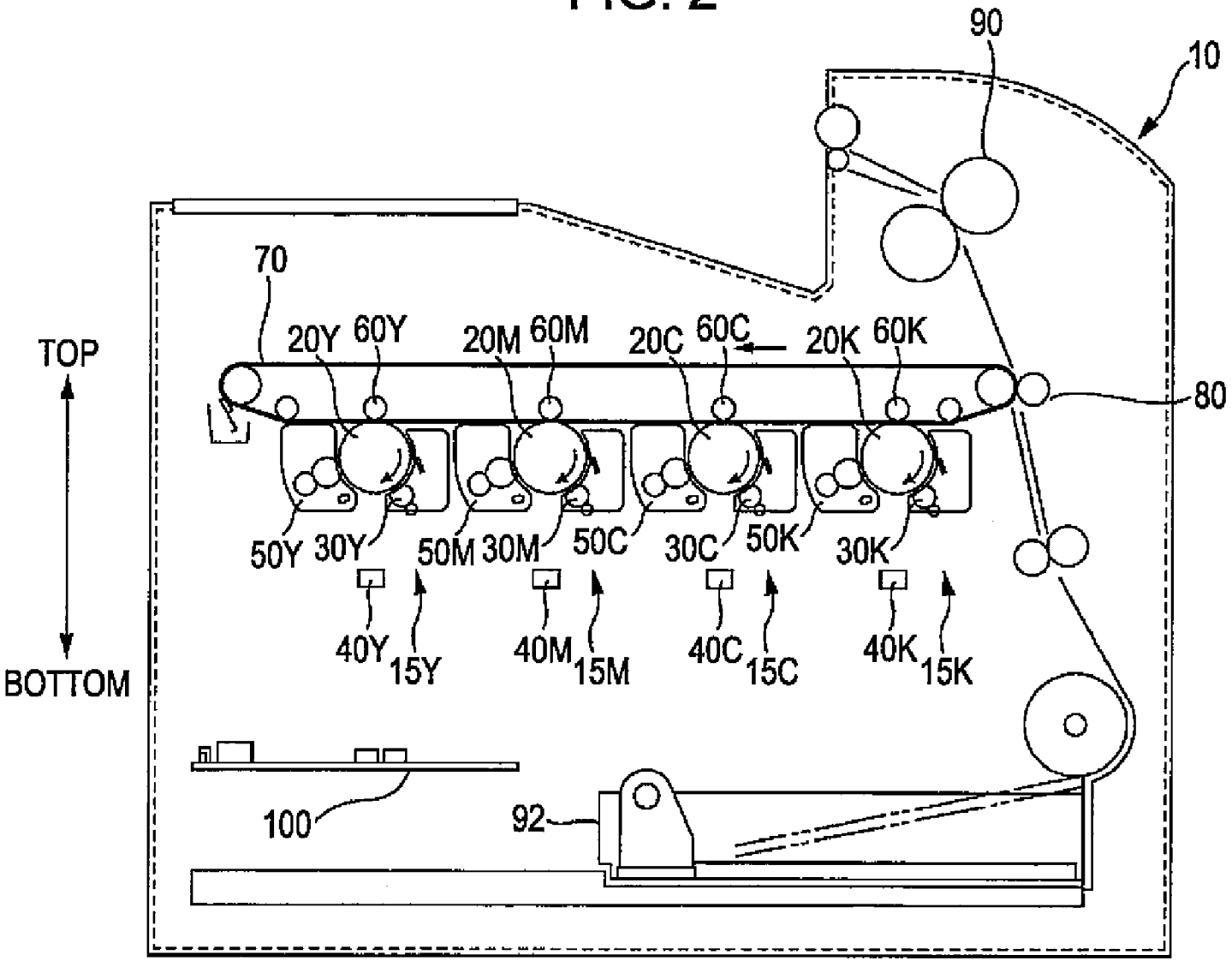
FIG. 2 is a diagram that schematically illustrates an example of the main components of a printer 10 according to an exemplary embodiment of the invention.
Figure 3:
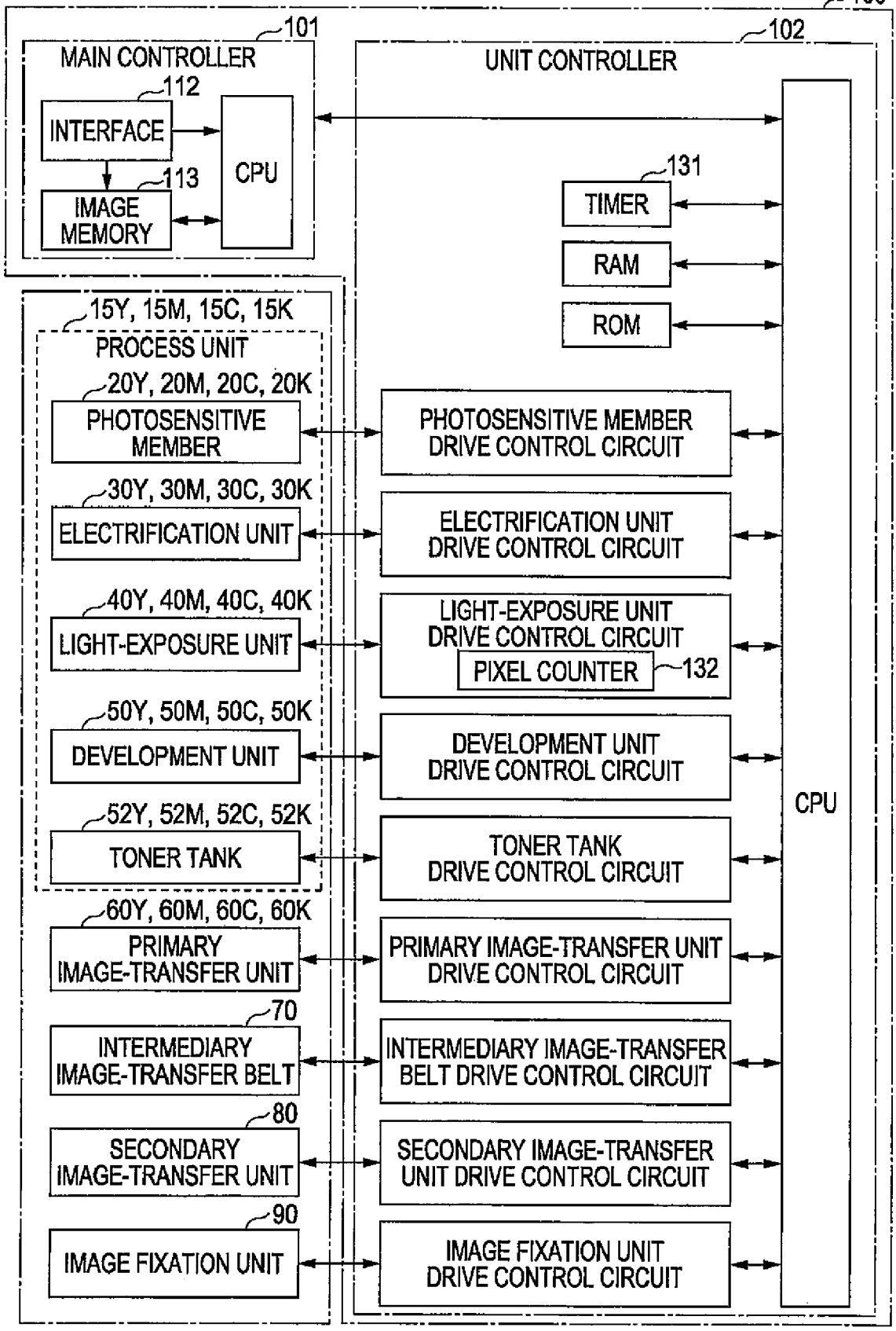
FIG. 3 is a block diagram that illustrates an example of the configuration of a control unit 100 of the printer 10, together with other functional units and components thereof, according to an exemplary embodiment of the invention.

With reference to FIGS. 2 and 3, an explanation is given below of an example of the configuration of the printer 10 and the operation thereof. FIG. 2 is a diagram that schematically illustrates an example of the main components of the printer 10 according to an exemplary embodiment of the invention. FIG. 3 is a block diagram that illustrates an example of the configuration of a control unit 100 of the printer 10, together with other functional units and components thereof, according to an exemplary embodiment of the invention. It should be noted that the double-headed arrow shown in FIG. 2 indicates the vertical orientation of the printer 10. For example, a paper-feed tray 92 is provided at the lower/bottom portion of the printer 10. An image fixation unit 90 is provided at the upper/top portion thereof.

Configuration of Printer 10

It is assumed herein that the printer 10 is a so-called laser-beam printer. As illustrated in FIG. 2, the printer 10 has process units 15Y, 15M, 15C, and 15K, an intermediary image-transfer belt 70, primary image-transfer units 60Y, 60M, 60C, and 60K, a secondary image-transfer unit 80, the image fixation unit 90, and the control unit 100. The control unit 100, which controls these units without any limitation thereto, is a non-limiting example of a "controlling section" according to the invention that is responsible for controlling the operations of the printer 10 as a whole.

Each of the process units 15Y, 15M, 15C, and 15K has a function of visualizing a latent image, which is formed on a corresponding photosensitive member 20Y, 20M, 20C, or 20K, so as to form a toner image by means of a toner. Herein, the photosensitive member 20Y, 20M, 20C, or 20K is a non-limiting example of an "image carrier" according to the invention. The toner is a non-limiting example of a "developer" according to the invention. These process units 15Y, 15M, 15C, and 15K are provided so as to correspond to color components of yellow (Y), magenta (M), cyan (C), and black (K), respectively. These process units 15Y, 15M, 15C, and 15K are aligned in a horizontal direction as illustrated in FIG. 2.

The configuration of the process unit 15Y is the same as those of the remaining three process units 15M, 15C, and 15K. Therefore, the configuration of the process unit 15Y is explained below. The process unit 15Y visualizes, after the formation of a latent image on the photosensitive member 20Y, the latent image formed thereon so as to generate a yellow-toner image by means of a yellow toner. The process unit 15Y has the photosensitive member 20Y, an electrification unit 30Y, a light-exposure unit 40Y, a development unit SOY, and a toner tank 52Y (refer to FIG. 3).

The photosensitive member 20Y has a photosensitive layer. The photosensitive member 20Y carries a latent image on the surface of the photosensitive layer thereof. The photosensitive member 20Y is supported on the body of the printer 10 in a rotatable manner. As indicated by an arrow shown in FIG. 2, the photosensitive member 20Y rotates clockwise. The electrification unit 30Y electrifies the photosensitive member 20Y. The light-exposure unit 40Y forms a latent image on the electrified photosensitive member 20Y by irradiating a laser thereon. The development unit 50Y has a toner container 530 that contains yellow (Y) toner that is fed from the toner tank 52Y. The development unit 50Y visualizes (i.e., develops) the latent image formed on the photosensitive member 20Y so as to form a yellow-toner image by means of the yellow toner. The toner tank 52Y contains a yellow (Y) toner that is to be supplied to the development unit SOY. A more detailed explanation of the configuration of the development unit 50Y will be given later.

The intermediary image-transfer belt 70 is an intermediary image-transfer medium that is used for transferring, onto a sheet of print target paper, a toner image of each color component that is carried on the corresponding one of four photosensitive members 20Y, 20M, 20C, and 20K. The intermediary image-transfer belt 70 turns with a toner image carried thereon. Each of the primary image-transfer units 60Y, 60N, 60C, and 60K is a device that transfers a toner image formed on the corresponding one of the photosensitive members 20Y, 20M, 20C, and 20K onto the intermediary image-transfer belt 70, which constitutes a primary image transfer process. The secondary image-transfer unit 80 is a device that transfers a single-color toner image or a full-color toner image that is formed on the intermediary image-transfer belt 70 onto a sheet of print target paper, which constitutes a secondary image transfer process. The image fixation unit 90 is a device that applies heat and pressure onto a single-color toner image or a full-color toner image that is transferred to a sheet of print target paper so as to form an indelible image thereon.

As illustrated in FIG. 3, the control unit 100 is made up of a main controller 101 and a unit controller 102. An image signal and a control signal are inputted into the main controller 101. The unit controller 102 controls each of the aforementioned functional units and components in response to instructions issued on the basis of the image signal and the control signal so as to form an image. The main controller 101 is connected to the computer 702 via the interface 112 thereof. The main controller 101 has an image memory 113. The image memory 113 stores an image signal that is inputted from the computer 702. The unit controller 102 is electrically connected to each of the functional units of the printer 10. Upon reception of a signal from a sensor that is provided on each thereof, the unit controller 102 controls the functional unit while detecting the state thereof on the basis of a signal that is inputted from the main controller 101.

Operations of Printer 10

The printer 10 having a configuration described above is capable of forming a single-color image or a full-color image. In the following description, the full-color image formation processing of the printer 10 is explained below.

As a first step, an image signal (aforementioned image data PD) and a control signal COM are inputted from the computer 702 into the main controller 101 of the printer 10 via the interface 112 thereof. Then, in response to a command issued from the main controller 101, the photosensitive members 20Y, 20M, 20C, and 20K, the intermediary image-transfer belt 70, and the like, rotate under the control of the unit controller 102.

The photosensitive members 20Y, 20M, 20C, and 20K rotate to their respective electrification positions. At the electrification positions, the electrification units 30Y, 30M, 30C, and 30K electrify the photosensitive members 20Y, 20M, 20C, and 20K respectively in a sequential manner. As the photosensitive member 20Y/20M/20C/20K further rotates, the electrified region of the photosensitive member 20Y/20M/20C/20K reaches a light-exposure position. The light-exposure unit 40Y/40M/40C/40K forms a latent image corresponding to yellow (Y)/magenta (M)/cyan (C)/black (K) at the electrified region thereof. As the photosensitive member 20Y/20M/20C/20K further rotates, the latent image formed thereon reaches a development position. Then, the development unit 50Y/50M/50C/50K visualizes (i.e., develops) the latent image formed on the photosensitive member 20Y/20M/20C/20K so as to form a toner image thereon.

As the photosensitive member 20Y/20M/20C/20K further rotates, the single-color toner image (e.g., yellow toner image) that is formed on the photosensitive member 20Y/20M/20C/20K reaches a primary image-transfer position. Then, the primary image-transfer unit 60Y/60M/60C/60K transfers the toner image formed on the photosensitive member 20Y/20M/20C/20K onto the intermediary image-transfer belt 70, which constitutes the aforementioned primary image transfer process. As a result thereof, a full-color toner image is formed on the intermediary image-transfer belt 70. As the photosensitive member 20Y/20M/20C/20K further rotates, the full-color toner image that is formed on the intermediary image-transfer belt 70 reaches a secondary image-transfer position. Then, the secondary image-transfer unit 80 transfers the full-color toner image that is formed on the intermediary image-transfer belt 70 onto a sheet of print target paper that is transported from the paper-feed tray 92, which constitutes the aforementioned secondary image transfer process.

Thereafter, the sheet of print target paper on which the full-color toner image is transferred in the second image transfer process is transported to the image fixation unit 90. Then, the image fixation unit 90 applies heat and pressure onto the full-color toner image transferred to the sheet of print target paper for the purpose of image fixation. In this way, a full-color image is formed on a sheet of print target paper.

Exemplary Configuration and Operation of Development Unit

As explained above, the printer 10 has the above-described four development units 50Y, 50M, 50C, and 50K. The configuration of the development unit 50Y is the same as those of the remaining three development units 50M, 50C, and 50K. Therefore, in the following description, an example of the configuration of the yellow development unit 50Y (hereafter simply referred to as development unit 50Y) is explained. An operation example of the development unit SOY is also explained below.

Exemplary Configuration of Development Unit

Figure 4:
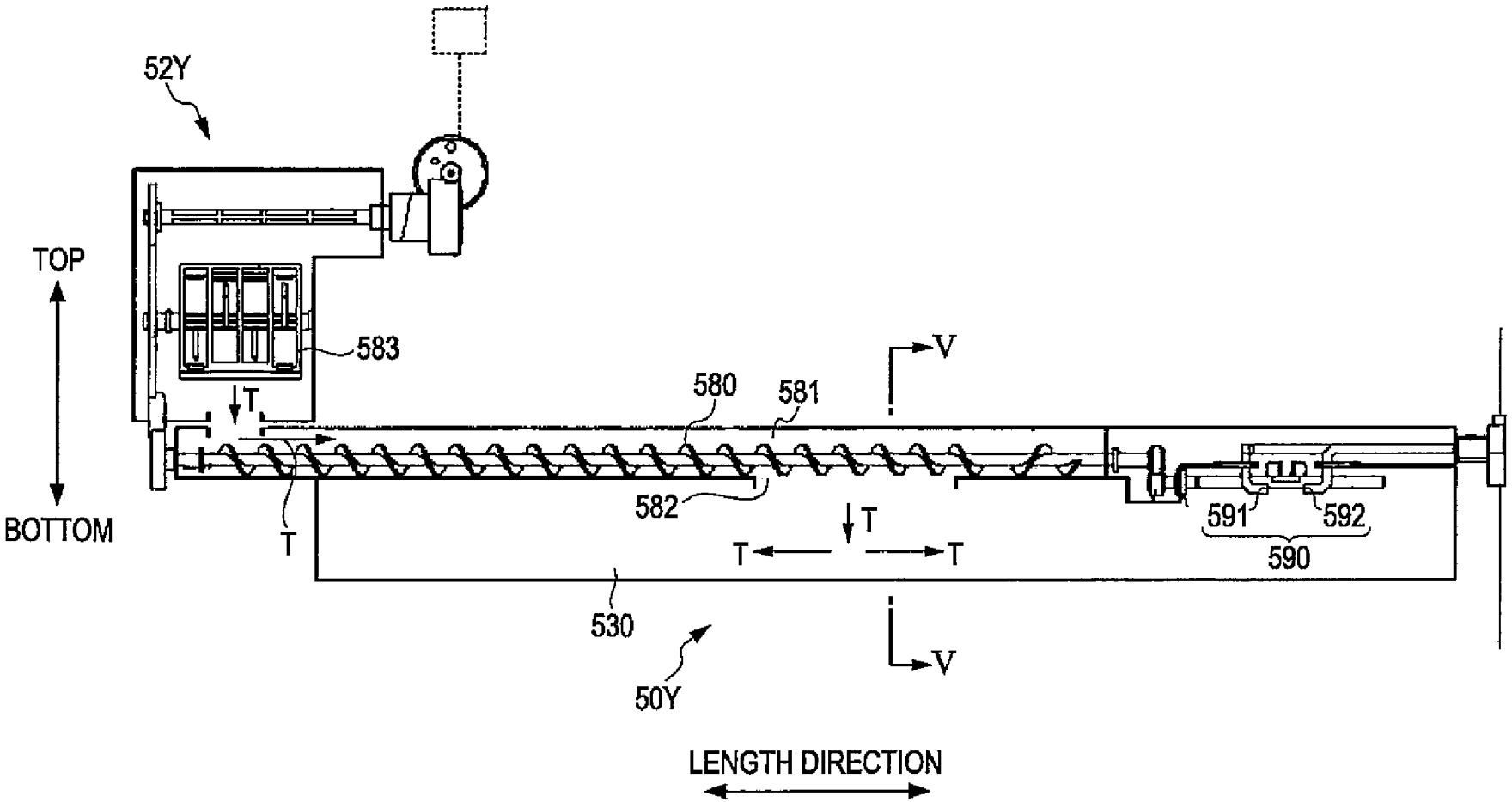
FIG. 4 is a diagram that schematically illustrates an example of the configuration of a development unit 50Y and a toner tank 52Y according to an exemplary embodiment of the invention.
Figures 5, 6:
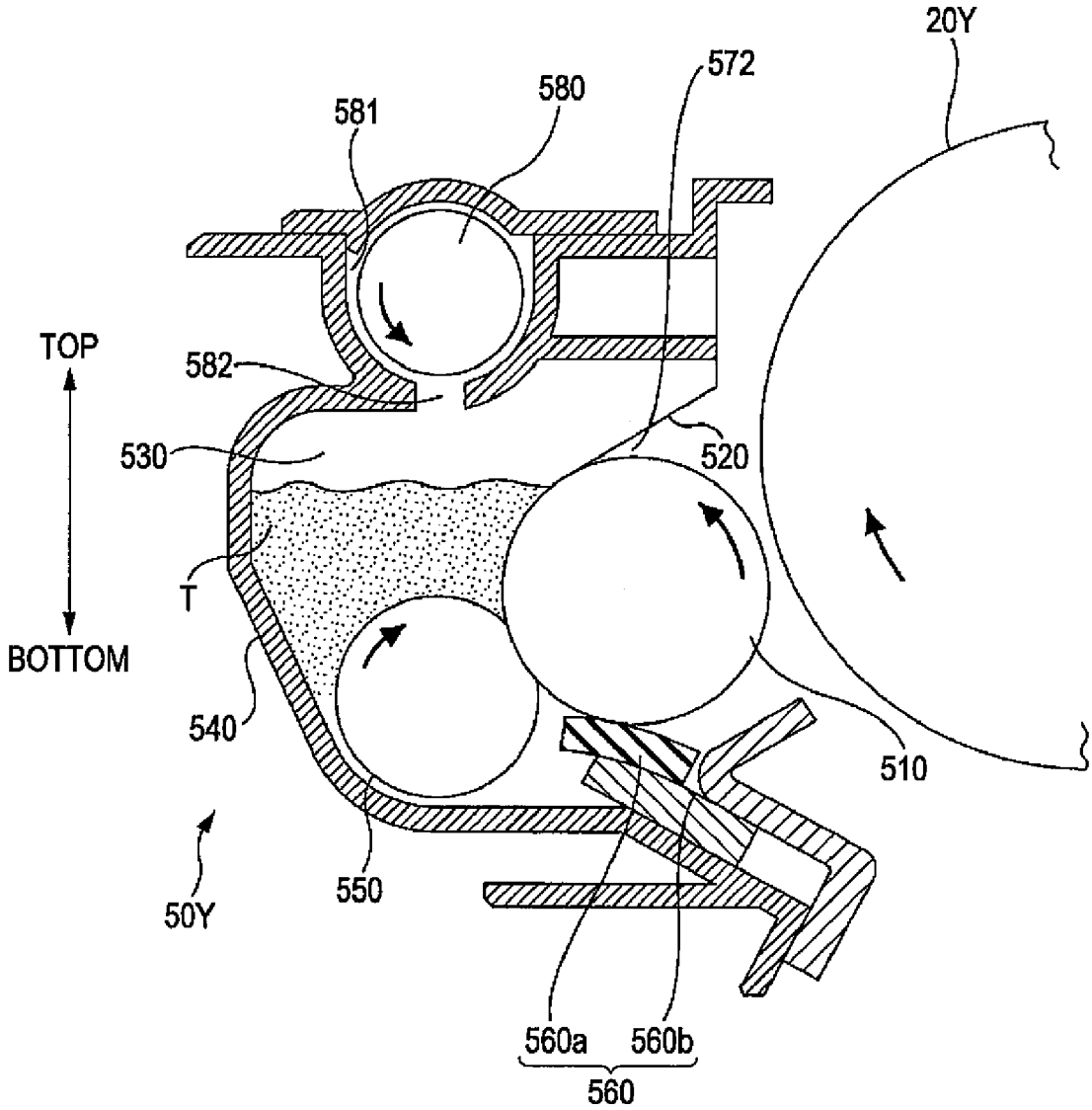
FIG. 5 is a sectional view taken along the line V-V of FIG. 4; specifically, this drawing schematically illustrates an example of the major constituent elements of the development unit 50Y according to an exemplary embodiment of the invention.
FIG. 6 is a table that shows the relationship between the type of print target paper, the speed mode, and the rotation speed of a development roller 510 according to an exemplary embodiment of the invention.

FIG. 4 is a diagram that schematically illustrates an example of the configuration of the development unit 50Y and the toner tank 52Y according to an exemplary embodiment of the invention. FIG. 5 is a sectional view taken along the line V-V of FIG. 4. Specifically, this drawing schematically illustrates an example of the major constituent elements of the development unit 50Y according to an exemplary embodiment of the invention. The horizontal double-headed arrow illustrated in FIG. 4 indicates the length direction of the development unit SOY, whereas the vertical double-headed arrow illustrated in FIG. 4 indicates the top/bottom orientation thereof. In addition, the vertical double-headed arrow illustrated in FIG. 5 indicates the top/bottom orientation of the development unit SOY.

As illustrated in FIG. 5, the development unit 50Y is provided with a development roller 510, a sealing member 520, a toner container 530, a housing 540, a toner-supplying roller 550, a toner-thickness controlling blade 560, and a toner-transport screw 580. The development roller 510 is a non-limiting example of a "developer carrier" according to the invention. The toner container 530 is a non-limiting example of a "containing section" according to the invention. The toner-transport screw 580 is a non-limiting example of a "replenishing member" according to the invention. In addition to the above-described components, the development unit 50Y is further provided with a toner-detecting sensor 590, which is illustrated in FIG. 4. The toner-detecting sensor 590 is a non-limiting example of a "detecting member" according to the invention. It should be noted that some components of the development unit 50Y are omitted from FIG. 4. For example, the development roller 510 is not shown therein.

The development roller 510 carries a toner T. The development roller 510 of the development unit 50Y visualizes (i.e., develops) a latent image that is carried on the photosensitive member 20Y so as to form a toner image by means of the toner T. The development roller 510 is made of metal such as aluminum, stainless, or steel, though not limited thereto. The housing 540 supports the development roller 510. The development roller 510 rotates around its center axis in a direction reverse to the rotation direction of the photosensitive member 20Y, or in other words, in a counterclockwise direction (refer to FIG. 5) that is reverse to the rotation direction (clockwise direction; refer to FIG. 5) of the photosensitive member 20Y. A clearance is formed between the development roller 510 and the photosensitive member 20Y. The development roller 510 develops a latent image that is formed on the photosensitive member 20Y with no contact therebetween. When a latent image that is formed on the photosensitive member 20Y is developed, an alternating electric field is generated between the development roller 510 and the photosensitive member 20Y.

The toner-containing space (i.e., toner container) 530 in which the toner T is contained is formed inside the housing 540. The housing 540 (toner container 530) has an opening 572 that is in communication with the outside of the housing 540. The development roller 510 is provided in such a manner that a circumferential surface of the development roller 510 faces the opening 572 when viewed from the outside of the housing 540. Accordingly, a part of the development roller 510 is exposed thereat.

The toner-supplying roller 550 is provided inside the toner container 530. The toner-supplying roller 550 supplies the toner T that is retained in the toner container 530 to the development roller 510. The toner-supplying roller 550 is made of polyurethane foam or the like. The toner-supplying roller 550 is in contact with the development roller 510 in such a manner that the toner-supplying roller 550 is in an elastically deformed state. The toner-supplying roller 550 turns around its center axis in a direction reverse to the rotation direction of the development roller 510, or in other words, in a clockwise direction (refer to FIG. 5).

The toner-thickness controlling blade 560 is in contact with the development roller 510. The toner-thickness controlling blade 560 applies an electric charge to the toner T that is carried on the development roller 510. In addition thereto, the toner-thickness controlling blade 560 adjusts the thickness of the toner T that is carried on the development roller 510. The toner-thickness controlling blade 560 is made up of, though not necessarily limited thereto, a rubber member 560*a* that contacts the development roller 510 and a rubber-supporting member 560*b* that supports the rubber member 560*a*. The rubber portion 560*a* of the toner-thickness controlling blade 560 is made of, for example, silicon rubber, urethane rubber, or the like. The rubber-supporting portion 560*b* thereof is configured as a thin plate that has spring elasticity. The rubber-supporting member 560*b* is made of phosphoric bronze (i.e., phosphor bronze), stainless, or the like.

The sealing member 520 is in contact with the development roller 510. The sealing member 520 prevents the leakage of the toner T that is contained in the container 530. In addition to such a function, the sealing member 520 collects, into the toner container 530, the toner T that remains carried on the development roller 510 without being used for development. Specifically, the sealing member 520 collects the unused toner T without scraping it off from the development roller 510 so that it re-enters the toner container 530. The sealing member 520 is a configured as a seal that is made of polyethylene film or the like.

The toner-transport screw 580 transports the toner T, which has been fed from the toner tank 52Y (refer to FIG. 4), to a toner-dropping port 582 so as to supply the toner T through the toner-dropping port 582 into the toner container 530 as replenishment. The toner-transport screw 580 is provided over the toner container 530. The toner-transport screw 580 is provided in such a manner that it can rotate in a toner-transport channel (i.e., toner-transport passage) 581 that is formed by the housing 540. Receiving a driving force from another driving source that is not the same as the driving source of the development roller 510, the toner-transport screw 580 rotates in interlock with the rotation of a stirring axis 583 (refer to FIG. 4) that is provided in the toner tank 52Y.

The toner-detecting sensor 590 detects whether or not the "water" level (i.e., height) of the toner T that is retained in the toner container 530 is at a replenishment start level (i.e., replenishment start height) H1 at which the toner-transport screw 580 should start the replenishing of the toner T. In addition thereto, the toner-detecting sensor 590 further detects whether or not the water level of the toner T that is retained in the toner container 530 is at a replenishment end level (i.e., replenishment end height) H2 at which the toner-transport screw 580 should end the replenishing of the toner T. The toner-detecting sensor 590 is a light-transmissive optical sensor. The toner-detecting sensor 590 has a light-emitting portion 591 that emits light and a light-receiving portion 592 that receives light that has been emitted from the light-emitting portion 591 thereof. When the toner T is present between the light-emitting portion 591 of the toner-detecting sensor 590 and the light-receiving portion 592 thereof, the toner T shuts off light that is emitted from the light-emitting portion 591 thereof. As the result thereof, the light-receiving portion 592 fails to receive light. In such a case, the light-receiving portion 592 of the toner-detecting sensor 590 sends an OFF signal to the control unit 100. On the other hand, when the toner T is absent between the light-emitting portion 591 of the toner-detecting sensor 590 and the light-receiving portion 592 thereof, there is no light-blocking object therebetween that shuts off light that is emitted from the light-emitting portion 591 thereof. As the result thereof, the light-receiving portion 592 receives light. In such a case, the light-receiving portion 592 of the toner-detecting sensor 590 sends an ON signal to the control unit 100.

Exemplary Operations of Development Unit

The development unit 50Y having the configuration described above performs the following operations when it develops a latent image that is formed on the photosensitive member 20Y. The toner-supplying roller 550 supplies the toner T that is retained in the toner container 530 to the development roller 510. As the development roller 510 rotates, the toner-thickness controlling blade 560 applies an electric charge to the toner T that is carried on the development roller 510. In addition thereto, the toner-thickness controlling blade 560 adjusts the thickness of the toner T that is carried on the development roller 510. As the development roller 510 further rotates, the thickness-adjusted toner T that is carried on the development roller 510 reaches a development position at which it faces the photosensitive member 20Y. Then, the toner T is used at the development position for the purpose of developing a latent image that is formed on the photosensitive member 20Y under an alternating electric field. As the development roller 510 further rotates, the toner T, which remains carried on the development roller 510 without being used for development, passes through the sealing member 520. The unused toner T is collected into the toner container 530 without being scraped off from the development roller 510 by the sealing member 520.

When the toner-detecting sensor 590 detects that the remaining amount of the toner T that is contained in the toner container 530 has decreased to reach a predetermined threshold, or in other words, when the light-receiving portion 592 thereof outputs an ON signal, the toner-transport screw 580 operates so as to replenish the toner T. A more detailed explanation as to how the toner T is replenished will be given later.

Relationship Between Paper Type and Development Roller Speed Mode

In the configuration of the printer 10 according to an exemplary embodiment of the invention, the rotation speed of the development roller 510 is not constant; that is, the rotation speeds of the development roller 510 differ from each other (or one another) depending on predetermined speed modes. Specifically, in the configuration of the printer 10 according to the present embodiment of the invention, the development roller 510 rotates either in "a first speed mode" or in "a second speed model". The first speed mode is a high-velocity operation mode in which the development roller 510 turns with a relatively high rotation speed. The second speed mode is a low-velocity operation mode in which the development roller 510 turns with a relatively low rotation speed. The speed mode is predetermined so as to correspond to each of the types of paper on which an image is formed. Therefore, the rotation speed of the development roller 510 differs so as to correspond to the type of print target paper.

The printer 10 is capable of forming an image on a plurality of types of print target paper. For example, the printer 10 is capable of forming an image on standard paper, OHP sheet, and thick paper, though not limited thereto. When an image is formed on a sheet of such paper, the development roller 510, though not limited thereto, rotates in a predetermined speed mode that corresponds to the paper type thereof.

FIG. 6 is a table that shows the relationship between the type of print target paper, the speed mode, and the rotation speed of the development roller 510. Information shown in this table is, for example, stored in ROM (refer to FIG. 3). The table shows that, if the type of print target paper is standard one, the speed mode is a high-speed mode, whereas it is a low-speed mode if print target paper is either OHP-sheet-type paper or thick-type paper The rotation speed of the development roller 510, the photosensitive member 20Y/20M/20C/20K, the intermediary image-transfer belt 70, and the image fixation unit 90 (hereafter, these components may be correctively referred to as "development roller 510 and other components") is relatively high when an image is formed on a sheet of standard paper. For this reason, in a case where an image is formed on a sheet of standard paper, the development roller 510 that turns with a comparatively high rotation speed develops a latent image that is carried on the photosensitive member 20Y/20M/20C/20K that also turns with a comparatively high rotation speed. On the other hand, in a case where an image is formed on a sheet of OHP paper or thick paper, the rotation speed of the development roller 510, the photosensitive member 20Y/20M/20C/20K, the intermediary image-transfer belt 70, and the image fixation unit 90 is relatively low. For this reason, in a case where an image is formed on a sheet of OHP paper or thick paper, the development roller 510 that turns with a comparatively low rotation speed develops a latent image that is carried on the photosensitive member 20Y/20M/20C/20K that also turns with a comparatively low rotation speed.

The reason why the speed modes differ depending on the types of print target paper is that the degree of easiness of toner-image fixation differs depending on the types of print target paper. In order to fix a toner image on a certain type of paper that has relatively low image-fixation property, it is necessary to carry out toner-image fixation process slowly while taking a relatively long time therein. This means that it is necessary to set the rotation speed of the image fixation unit 90 as well as the rotation speeds of the development roller 510 and other components at a low level. Specifically, it is necessary to set the rotation speed of the image-fixation roller of the image fixation unit 90 as well as the rotation speeds of the development roller 510, the photosensitive members 20Y/20M/20C/20K, the intermediary image-transfer belt 70, and the image fixation unit 90 at a low level. An image is formed as a result of the fixation of a toner image on a sheet of print target paper. Generally speaking, it is easier to fix a toner image on standard paper than to fix a toner image on OHP paper or thick paper. For this reason, in order to fix a toner image on a sheet of OHP paper or thick paper, it is necessary to set the rotation of the image-fixation roller of the image fixation unit 90 at a comparatively low speed. In accordance with the lower rotation speed of the image-fixation roller of the image fixation unit 90, it is necessary to set the rotation of the development roller 510 and other components at a comparatively low speed.

Overflow of Toner Contained in Toner Container Due to Difference in Speed Modes

As has already been described above, the toner T is contained in the toner container 530. If the "water" level of the toner T contained therein rises too high, the toner T might overflow the toner container 530, resulting in the leakage thereof. The printer 10 is provided with the aforementioned toner-detecting sensor 590 in order to avoid the water level of the toner T from rising too high. That is, the toner-detecting sensor 590 prevents the water level of the toner T from rising too high. Despite such a level-monitoring configuration of the printer 10, the overflow of the toner T that is contained in the toner container 530 could occur even when the water level of the toner T does not rise too high during the replenishing thereof. In the following description, an explanation is given as to how such an overflow of the toner T occurs.

As has already been described above in Related Art of this specification, as the development roller 510, which is provided in such a manner that it is partially exposed the opening 572, rotates, air enters the toner container 530 via the opening 572. Depending on the rotation speed of the development roller 510, the amount of air that enters the toner container 530 varies from one to another. Specifically, when the development roller 510 rotates in a high-speed mode, the amount of air that enters the toner container 530 via the opening 572 because of air entrainment that is attributable to the rotation of the development roller 510 is relatively large. On the other hand, when the development roller 510 rotates in a low-speed mode, the amount of air that enters the toner container 530 via the opening 572 because of air entrainment that is attributable to the rotation of the development roller 510 is relatively small.

For this reason, the amount of air that is entrained when the development roller 510 rotates in the low-speed mode at the time of the replenishing of the toner T on the condition that the toner T is replenished until the toner-detecting sensor 590 detects that the water level of the toner T that is retained in the toner container 530 has reached the aforementioned replenishment end level H2 is smaller in comparison with the amount of air that is entrained when the development roller 510 rotates in the high-speed mode at the time of the replenishing of the toner T on the same condition as above, that is, on the condition that the toner T is replenished until the toner-detecting sensor 590 detects that the water level of the toner T that is retained in the toner container 530 has reached the aforementioned replenishment end level H2. Accordingly, the amount of air that is contained in the toner container 530 when the development roller 510 rotates in the low-speed mode at the time of the replenishing of the toner T is smaller in comparison with the amount of air that is contained in the toner container 530 when the development roller 510 rotates in the high-speed mode at the time of the replenishing of the toner T. That is, the density of the toner T that is contained in the toner container 530 when the development roller 510 rotates in the low-speed mode at the time of the replenishing of the toner T is greater in comparison with the density of the toner T that is contained in the toner container 530 when the development roller 510 rotates in the high-speed mode at the time of the replenishing of the toner T. As a result thereof, the amount of the toner T that is contained in the toner container 530 when the development roller 510 rotates in the low-speed mode at the time of the replenishing of the toner T is larger in comparison with the amount of the toner T that is contained in the toner container 530 when the development roller 510 rotates in the high-speed mode at the time of the replenishing of the toner T.

Then, if the rotation of the development roller 510 enters the high-speed mode for the purpose of developing a latent image after that the amount of the toner T that is contained in the toner container 530 has increased (become relatively large) due to the replenishing of the toner T performed when the development roller 510 rotates in the low-speed mode, air further enters the toner container 530 via the opening 572 because of air entrainment that is attributable to the rotation of the development roller 510 with an increased speed, which results in a decrease in the density of the toner T. As a result thereof, there is an adverse possibility that the water level of the toner T that is retained in the toner container 530 could go over the replenishment end level H2 at which the replenishing of the toner T should be ended, which could cause the leakage of the toner T out of the toner container 530. For example, there is a risk that the toner T could overflow the peripheral region of the sealing member 520, resulting in the leakage thereof.

Toner Replenishment Control According to Exemplary Embodiment of Invention

In order to address the above-identified problem without any limitation thereto, that is, in order to provide a solution to the non-limiting problem of the overflow/leakage of the toner T contained in the toner container 530, the printer 10 according to the present embodiment of the invention performs toner-replenishment control as described below. As has already been described above, the printer 10 has four process units 15Y, 15M, 15C, and 15K. Toner-replenishment control that is applied to the process unit 15Y is the same as those applied to the remaining three process units 15M, 15C, and 15K. For this reason, in the following description, the toner-replenishment control that is applied to the process unit 15Y is explained (that is, an explanation is given below as to how the replenishment of the toner T is controlled in the development unit 50Y).

When the replenishment of the toner T is controlled, the control unit 100 is mainly responsible for conducting various kinds of controlling operations. In particular, in the configuration of the printer 10 according to the present embodiment of the invention, the CPU executes a program that is stored in the ROM so as to control the replenishment of the toner T. The program is made up of codes for performing various kinds of operations explained below.

Figure 7:
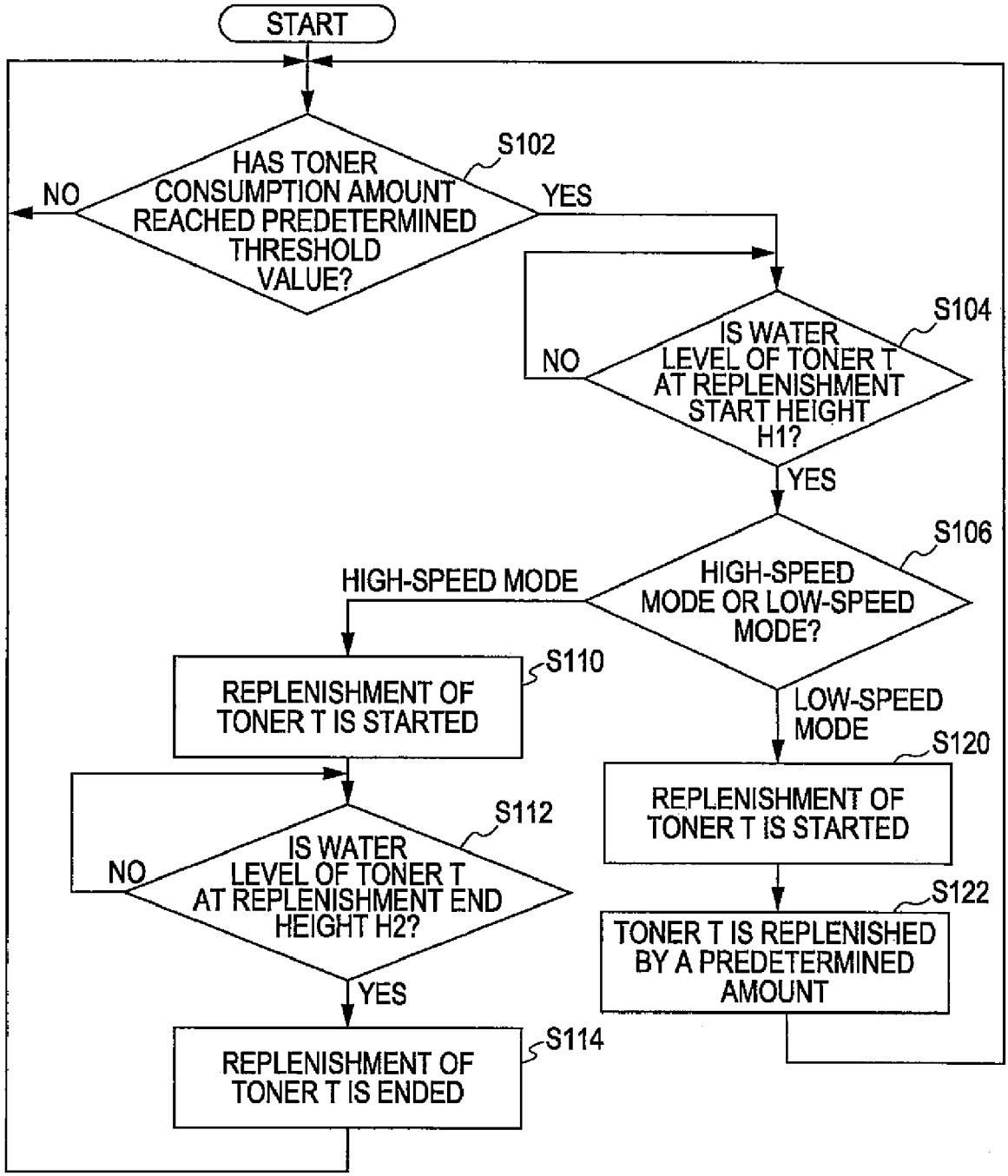
FIG. 7 is a flowchart that illustrates the processing flow of toner-replenishment control according to an exemplary embodiment of the invention.

FIG. 7 is a flowchart that illustrates the processing flow of toner-replenishment control according to an exemplary embodiment of the invention. The processing flow that is illustrated in the flowchart of FIG. 7 starts at the time when the computer 702 transmits an image signal (image data PD) and a control signal COM to the printer 10. The control signal COM contains a command for executing image-formation processing on a plurality of sheets of print target paper on the basis of either the high-speed mode or the low-speed mode.

The image-formation operations are conducted during the execution of the toner-replenishment control. The toner T is consumed in the process of the image-formation operations. As the toner T is consumed, the amount of the toner T that is contained in the toner container 530 decreases. The image-formation operations are performed on the basis of either the high-speed mode or the low-speed mode depending on the type of print target paper on which an image is formed. Specifically, an image is formed on the basis of the high-speed mode in a case where the type of print target paper is standard one, whereas an image is formed on the basis of the low-speed mode in a case where the type of print target paper is OHP sheet or thick paper. Information related to the type of print target paper is contained in a signal received from the computer 702, though not necessarily limited thereto.

As a first step of the toner-replenishment control described herein, the control unit 100 judges whether the amount of the toner T that has been consumed in the image formation process, which is a cumulative value, has reached a predetermined threshold value or not (step S102). The consumption amount of the toner T is proportional to the number of pixels of the image data PD. Information on the consumption amount of the toner T is acquired as follows. As illustrated in FIG. 3, the control unit 100 has a pixel counter 132 that counts the number of pixels. As the pixel counter 132 counts the number of pixels, the control unit 100 acquires information on the consumption amount of the toner T that is a cumulative value.

If the control unit 100 judges that the consumption amount of the toner T, the information on which is acquired as a cumulative value, has reached the predetermined threshold value (step S102: Yes), the control unit 100 commands the toner-detecting sensor 590 to detect whether the water level of the toner T that is retained in the toner container 530 is at the replenishment start level H1 at which the replenishing of the toner T should be started (step S104). It should be noted that the threshold is set at a value that is smaller than the amount of toner T that is consumed until the water level of the toner T that initially lies at the replenishment end level H2 falls to the replenishment start level H1.

Figure 8A:
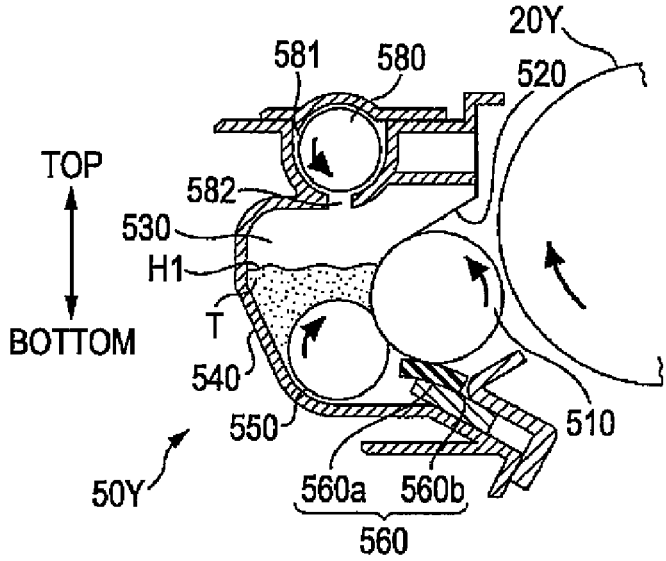
FIG. 8A is a diagram that schematically illustrates that the height (i.e., level) of a toner T is at a replenishment start level H1.

During the above-mentioned detection conducted by the toner-detecting sensor 590, the amount of the toner T decreases because of further consumption thereof. At the time when the toner-detecting sensor 590 detects that the height of the toner T that is retained in the toner container 530 is at the replenishment start level H1 at which the replenishing of the toner T should be started (step S104: Yes), that is, at the time when the water level of the toner T that is retained in the toner container 530 is at the replenishment start level H1 as shown in FIG. 8A, the toner-transport screw 580 starts the replenishing of the toner T. FIG. 8A is a diagram that schematically illustrates that the height (i.e., water level) of the toner T is at the replenishment start level H1.

The detection result as to whether the height of the toner T is at the replenishment start level H1 or not is obtained as a result of judging whether the light-receiving portion 592 of the toner-detecting sensor 590 outputs an ON signal continuously or not for a predetermined time period, for example, five seconds. A timer 131 that is shown in FIG. 3 is operated for the measurement thereof. The above-described replenishment start level H1 is set at a height that is determined on the basis of an experiment conducted in advance. Specifically, the replenishment start level H1 is set at such a height that the light-receiving portion 592 of the toner-detecting sensor 590 outputs an continuous ON signal without causing any signal-level fluctuations between an ON state and an OFF state even when the toner T that is contained in the toner container 530 surges so that the water level thereof rises and falls because of the rotational operations of the development roller 510 and other components. Therefore, if the light-receiving portion 592 of the toner-detecting sensor 590 outputs an ON signal continuously for a predetermined length of time, it is judged that the height of the toner T that is contained in the toner container 530 is at the replenishment start level H1.

If it is judged that the height of the toner T that is contained in the toner container 530 is at the replenishment start level H1 (step S104: Yes), the toner-transport screw 580 starts the replenishing of the toner T. In the toner-replenishment control according to the present embodiment of the invention, a control flow that is used for the replenishment of the toner T when the development roller 510 is rotated in the high-speed mode is not the same as a control flow that is used for the replenishment of the toner T when the development roller 510 is rotated in the low-speed mode. In the following description, it is assumed that the development roller 510 rotates in the high-speed mode. An explanation of the toner-replenishment control that is applied when the development roller 510 rotates in the low-speed mode will be given thereafter.

Figure 8B:
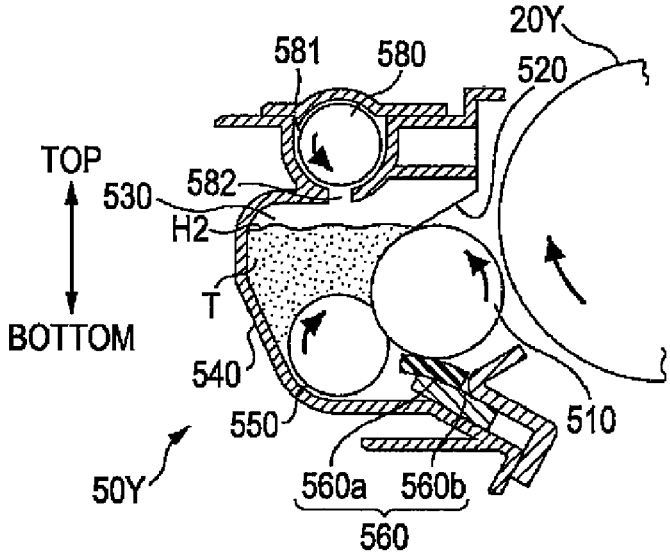
FIG. 8B is a diagram that schematically illustrates that the toner T has been replenished to the height of a replenishment end level H2 on the condition that the development roller 510 rotates in a high-speed mode.

If it is judged in step S106 that the development roller 510 rotates in the high-speed mode, the control unit 100 commands the replenishment of the toner T to be started (step S110). Then, the control unit 100 commands the toner-transport screw 580 to replenish the toner T until the toner-detecting sensor 590 detects that the height of the toner T that is retained in the toner container 530 has reached the replenishment end level H2 (step S112: Yes), which ends in step S114. As the result of the above-described series of processing, the water level of the toner T that is contained in the toner container 530 rises to the replenishment end height H2 as shown in FIG. 8B. FIG. 8B is a diagram that schematically illustrates that the toner T has been replenished to the height (i.e., water level) of the replenishment end level H2 on the condition that the development roller 510 rotates in the high-speed mode.

In the decision step S112, the toner-detecting sensor 590 makes a detection as to whether the height of the toner T is at the replenishment end level H2 or not. In the detection made in the step S112, it is judged whether the light-receiving portion 592 of the toner-detecting sensor 590 outputs an OFF signal continuously or not for a predetermined time period, for example, five seconds. The aforementioned timer 131 is operated for the measurement thereof. Note that the same applies to steps S204, S210, and S214 that will be explained later. The above-described replenishment end level H2 is set at a height that is determined on the basis of an experiment conducted in advance. Specifically, the replenishment end level H2 is set at such a height that the light-receiving portion 592 of the toner-detecting sensor 590 outputs an continuous OFF signal without causing any signal-level fluctuations between an ON state and an OFF state even when the toner T that is contained in the toner container 530 surges so that the water level thereof rises and falls because of the rotational operations of the development roller 510 and other components. Therefore, as understood from FIGS. 8A and 8B, the replenishment end level H2 is set at a level higher the replenishment start level H1. Therefore, if the light-receiving portion 592 of the toner-detecting sensor 590 outputs an OFF signal continuously for a predetermined length of time, it is judged that the height of the toner T that is contained in the toner container 530 is at the replenishment end level H2.

In the foregoing description of the toner-replenishment control according to the present embodiment of the invention, it is assumed that the development roller 510 rotates in the high-speed mode (the above-described steps S110-S114). In the following description, the toner-replenishment control according to the present embodiment of the invention that is applied when the development roller 510 rotates in the low-speed mode is explained.

If it is judged that the development roller 510 rotates in the low-speed mode in the step S106, unlike the above-described toner-replenishment control flow that is applied when the development roller 510 rotates in the high-speed mode, the control unit 100 commands that the toner T should be replenished by a predetermined amount without instructing the toner-detecting sensor 590 to make detection of the toner T (step S120, step S122).

Figure 8C:
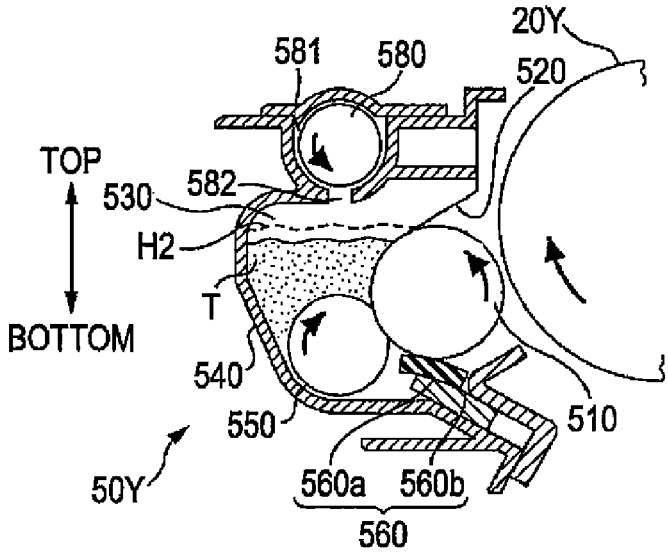
FIG. 8C is a diagram that schematically illustrates that the toner T has been replenished by a predetermined amount on the condition that the development roller 510 rotates in a low-speed mode.

It should be noted that such a predetermined amount is set on the basis of an experiment conducted in advance. That is, under an assumption that the development roller 510 rotates in the low-speed mode, the amount of the toner T that should be replenished by the toner-transport screw 580 from a start point at which the water level of the toner T lies at the replenishment start height H1 where the replenishment of the toner T should be started till an end point at which the water level of the toner T lies at the replenishment end height H2 where the replenishment of the toner T should be ended is acquired on the basis of a result of experiment. The aforementioned predetermined value/amount is set to be smaller than the experimentally acquired replenishment value/amount described above. For this reason, as illustrated in FIG. 8C, the water level of the toner T after replenishment thereof by the predetermined amount is lower than the replenishment end level H2. In addition, in the toner-replenishment control according to the present embodiment of the invention, the predetermined amount is set to be the same as, under an assumption that the development roller 510 rotates in the high-speed mode, the amount of the toner T that should be replenished by the toner-transport screw 580 from a start point at which the water level of the toner T lies at the replenishment start height H1 where the replenishment of the toner T should be started till an end point at which the water level of the toner T lies at the replenishment end height H2 where the replenishment of the toner T should be ended. FIG. 8C is a diagram that schematically illustrates that the toner T has been replenished by the predetermined amount on the condition that the development roller 510 rotates in the low-speed mode.

The processing flow that is illustrated in the flowchart of FIG. 7 ends at the time of completion of image-formation processing performed on the plurality of sheets of print target paper. Therefore, the toner T is replenished again after the initial replenishment thereof that is conducted during the execution of image-formation processing on the plurality of sheets of print target paper if the toner T is further consumed because of subsequent image formation (the above-described steps S102-S122).

In the toner-replenishment control according to the present embodiment of the invention, when the development roller 510 rotates in the low-speed mode, a water-level correction processing for adjusting the height of the toner T that is contained in the toner container 530 is performed after the replenishment of the toner T by the predetermined amount. In the following description, the water-level correction processing for adjusting the height of the toner T that is executed if the development roller 510 rotates in the low-speed mode is explained.

Figure 9:
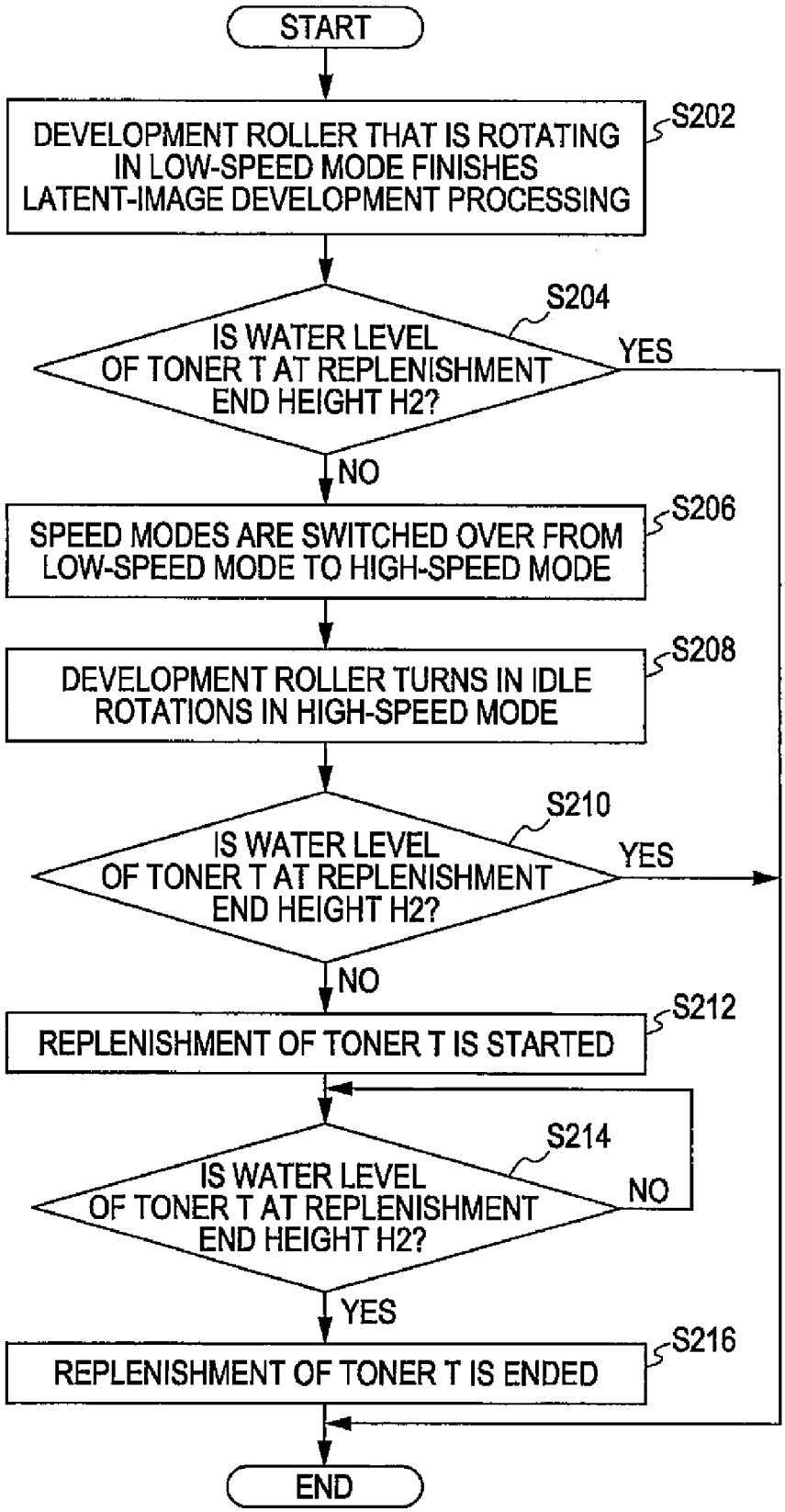
FIG. 9 is a flowchart that illustrates an example of a controlling flow for correcting the height of the toner T according to an exemplary embodiment of the invention.

FIG. 9 is a flowchart that illustrates an example of a controlling flow for correcting the height of the toner T according to an exemplary embodiment of the invention. The processing flow illustrated in the flowchart of FIG. 9 starts at the time when the development roller 510 rotating in the low-speed mode finishes latent-image development processing (step S202). More exactly, the processing flow illustrated in the flowchart of FIG. 9 starts at the time when the formation of images on all of the plurality of sheets of print target paper is completed.

After the completion of image formation on the plural sheets of print target paper, the control unit 100 checks whether the height (water level) of the toner T is at the replenishment end level H2 or not after the replenishment of the toner T by the predetermined amount. That is, the control unit 100 judges, by means of the toner-detecting sensor 590, whether the height of the toner T is at the replenishment end level H2 or not after the replenishment of the toner T by the predetermined amount (step S204).

If the toner-detecting sensor 590 detects that the height of the toner T lies at the replenishment end level H2 (step S204: Yes), the control unit 100 terminates the water-level correction processing flow illustrated in FIG. 9 without executing the replenishment of the toner T. On the other hand, if the toner-detecting sensor 590 detects that the water level of the toner T falls short of the replenishment end height H2 (step S204: No), the control unit 100 switches over the speed modes from the low-speed mode to the high-speed mode in order to adjust the height of the toner T (step S206).

After the switchover into the high-speed mode, the control unit 100 commands the development roller 510 to rotate in the high-speed mode without performing the development of a latent image (step S208). That is, the development roller 510 turns in idle rotations on the basis of the high-speed mode. As a result of such idle rotations, air enters the toner container 530 via the opening 572 so as to raise the water level (i.e., height) of the toner T. That is, as a result of such idle rotations, the water level of the toner T is raised to a height that is the same as the water level thereof that is obtained when the development roller 510 turns in the high-speed mode.

After a certain length of a time period has elapsed since the start of such idle rotations of the development roller 510, the control unit 100 judges, by means of the toner-detecting sensor 590, whether the height of the toner T is at the replenishment end level H2 or not (step S210). Then, if the toner-detecting sensor 590 detects that the height of the toner T lies at the replenishment end level H2 (step S210: Yes), the control unit 100 terminates the water-level correction processing flow illustrated in FIG. 9 without executing the replenishment of the toner T. On the other hand, if the toner-detecting sensor 590 detects that the water level of the toner T falls short of the replenishment end height H2 (step S210: No), the control unit 100 commands that the replenishment of the toner T should be started (step S212). In this toner replenishment step S212, unlike the foregoing toner-replenishment step S122 in which the toner T is replenished by the predetermined amount, the control unit 100 commands the toner-transport screw 580 to replenish the toner T until the water level of the toner T reaches the replenishment end height H2 (step S214: Yes), which ends in step S216. That is, the toner T is replenished under the same condition as that of the high-speed-mode toner replenishment (the above-described steps S110-S114). By this means, the height of the toner T is corrected. After the step S216, the controlling flow for correcting the height of the toner T according to the present embodiment of the invention ends.

As a non-limiting advantageous effect of the toner-replenishment control according to the present embodiment of the invention described above, when the development roller 510 rotates in the high-speed mode, the control unit 100 commands the replenishment of the toner T to be conducted on the basis of the result of detection made by the toner-detecting sensor 590. By this means, it is possible to accurately control the water level of the toner T that is retained in the toner container 530. On the other hand, as a non-limiting advantageous effect of the toner-replenishment control according to the present embodiment of the invention described above, when the development roller 510 rotates in the low-speed mode, the toner T is replenished by a predetermined amount (only). Therefore, it is possible to provide a solution to the problem of the overflow of the toner T after replenishment thereof. In addition thereto, in the water-level correction processing according to the present embodiment of the invention described above, after the replenishing of the toner T by the predetermined amount, the development roller 510 is operated in idle rotations on the basis of the high-speed mode, and the toner-detecting sensor 590 detects the height of the toner T. Therefore, it is possible to avoid any significant deviation (i.e., height/level difference) of the actual water level of the toner T obtained after the replenishment thereof by the predetermined amount from the replenishment end level H2.

In the water-level correction processing according to the exemplary embodiment of the invention described above, it is explained that the idle rotations of the development roller 510 are executed (in the step S208) after the development roller 510 rotating in the low-speed mode finishes latent-image development processing (the step S202), specifically, after the completion of image formation on all of the plural sheets of print target paper. However, the water-level correction flow of the invention should be in no case understood to be limited to such an example. As a non-limiting modification example thereof, the idle rotations of the development roller 510 may be executed during the process of image formation on the plural sheets of print target paper, more specifically, each after the completion of image formation on not all but some of the plural (i.e., predetermined number) sheets of print target paper. In such a modification example, the idle rotations of the development roller 510 are executed during a pause of image-formation processing. With such a modification example, the height of the toner T that is contained in the toner container 530 is more frequently checked, resulting in easier/enhanced control of the water level of the toner T.

In the water-level correction processing according to the exemplary embodiment of the invention described above, it is explained that the idle rotations of the development roller 510 are executed in the step S208. Notwithstanding the foregoing, that the idle rotations of the development roller 510 may be skipped if image formation on the basis of the high-speed mode is performed immediately after the image formation on the basis of the low-speed mode. This is because the series of operations that are performed after the execution of the idle rotations of the development roller 510 (the above-described steps S212-S216) is the same as the series of toner replenishment operations that are performed under the high-speed mode (the above-described steps S110-S114).

Non-Limiting Advantages Offered by Printer 10

As has already been explained above, a "controlling section" according to the invention, a non-limiting example of which is the control unit 100 according to the foregoing exemplary embodiment thereof, executes the following toner-replenishment control. As illustrated in FIG. 7, the "controlling section" (e.g., control unit 100) commands the "replenishing member" (e.g., toner-transport screw 580) to replenish a "developer" (e.g., toner T) until the "detecting member" (e.g., toner-detecting sensor 590) detects that the height of the developer that is contained in the containing section (e.g., toner container 530) is at the replenishment end level H2 if the detecting member detects, in the step S104, that the height of the developer that is contained in the containing section is at the replenishment start level H1 when the "developer carrier" (e.g., development roller 510) that rotates on the basis of the first speed mode (i.e., rotates in the high-speed mode) develops the latent image (steps S110-S114). On the other hand, the controlling section (e.g., control unit 100) commands the replenishing member (e.g., toner-transport screw 580) to replenish a developer (e.g., toner T) by a predetermined amount if the detecting member (e.g., toner-detecting sensor 590) detects, in the step S104, that the height of the developer that is contained in the containing section (e.g., toner container 530) is at the replenishment start level H1 when the developer carrier (e.g., development roller 510) that rotates on the basis of the second speed mode (i.e., rotates in the low-speed mode) develops the latent image (steps S120 and S122).

If it is judged that the development roller 510 rotates in the low-speed mode, which means that the amount of air that enters the toner container 530 via the opening 572 because of air entrainment that is attributable to the rotation of the development roller 510 is relatively small, the control unit 100 commands that the toner T should be replenished by a predetermined amount without instructing the toner-detecting sensor 590 to make detection of the toner T. Therefore, although the density of the toner T that is contained in the toner container 530 when the development roller 510 rotates in the low-speed mode at the time of the replenishing of the toner T is greater in comparison with the density of the toner T that is contained in the toner container 530 when the development roller 510 rotates in the high-speed mode at the time of the replenishing of the toner T, it is possible to prevent any excessive replenishment of the toner T into the toner container 530. If the rotation of the development roller 510 enters the high-speed mode for the purpose of developing a latent image after that the amount of the toner T that is contained in the toner container 530 has increased (become relatively large) due to the replenishing of the toner T performed when the development roller 510 rotates in the low-speed mode, air further enters the toner container 530 via the opening 572 because of air entrainment that is attributable to the rotation of the development roller 510 with an increased speed, which results in a decrease in the density of the toner T. Nevertheless, it is possible to prevent the "water" level (i.e., height) of the toner T from rising too high because the control unit 100 commands that the toner T should be replenished by a predetermined amount (only). Thus, it is possible to prevent any overflow/leakage of the toner T out of the toner container 530 after the replenishment of the toner T.

If it is judged that the development roller 510 rotates in the high-speed mode, which means that the amount of air that enters the toner container 530 via the opening 572 because of air entrainment that is attributable to the rotation of the development roller 510 is relatively large, the control unit 100 commands that the toner T should be replenished on the basis of the detection made by the toner-detecting sensor 590 under a relatively low toner-density condition, which makes it possible to prevent the water level of the toner T from rising too high at the time of replenishment thereof. Thus, the overflow/leakage of the toner T out of the toner container S30 does not occur.

As explained above, in the toner-replenishment control method according to an exemplary embodiment of the invention described above, even under an assumption that the rotation speeds of the development roller 510 differ from each other (or one another) depending on predetermined speed modes, it is possible to command the toner-transport screw 580 to replenish the toner T in such a manner that the toner T never overflows the peripheral region of the sealing member 520, which means the effective prevention of leakage thereof.

Other Non-Limiting Exemplary Embodiments

In the foregoing description, the present invention is explained while discussing some exemplary embodiments of the invention (as well as minor variations/modifications thereof). These specific embodiments (as well as minor variations/modifications thereof) of an "image formation apparatus" according to the invention described above are provided solely for the purpose of facilitating the understanding of the invention. It should be noted that, in no case, these explanatory embodiments are interpreted to limit the scope of the invention. The invention may be modified, altered, changed, adapted, and/or improved within a range not departing from the gist and/or spirit of the invention apprehended by a person skilled in the art from explicit and implicit description made herein, where such a modification, an alteration, a change, an adaptation, and/or an improvement is also covered by the scope of the appended claims. It is the intention of the inventor/applicant that the scope of the invention covers any equivalents thereof without departing therefrom.

In the configuration of the printer 10 according to the foregoing exemplary embodiment of the invention, it is explained that the toner-detecting sensor 590 is a light-transmissive optical sensor that has the light-emitting portion 591 and the light-receiving portion 592. However, the configuration of the toner-detecting sensor 590 is not limited to such an example. As a few modification examples thereof, though not limited thereto, the toner-detecting sensor 590 may be configured as a mechanical sensor or a piezoelectric sensor that uses a piezoelectric element.

In the water-level (i.e., height) correction processing according to the foregoing exemplary embodiment of the invention, as illustrated in FIG. 9, it is explained that the control unit 100 commands the development roller 510 to rotate in the high-speed mode without performing the development of a latent image (step S208) after the development roller 510 rotating in the low-speed mode has finished latent-image development processing. That is, in the height correction processing according to the foregoing exemplary embodiment of the invention, it is explained that the control unit 100 commands the development roller 510 to turn in idle rotations on the basis of the high-speed mode. However, the processing flow of the height correction processing according to the foregoing exemplary embodiment of the invention is not limited to such an example. For example, the control unit 100 may command the development roller 510 to enter a pause state without having it turn in idle rotations on the basis of the high-speed mode after the development roller 510 rotating in the low-speed mode has finished latent-image development processing. However, the height correction processing according to the foregoing exemplary embodiment of the invention is preferable to and advantageous over the variation example described above in that it is possible to check the height of the toner T during the operation under the high-speed mode by rotating the development roller 510 in an idle manner on the basis of the high-speed mode.

In the water-level correction processing according to the foregoing exemplary embodiment of the invention, as illustrated in FIG. 9, it is explained that, if the toner-detecting sensor 590 detects that the water level of the toner T falls short of the replenishment end height H2 (step S210: No) even after the development roller 510 has rotated in the high-speed mode (i.e., in an idle manner) without performing the development of a latent image under the command of the control unit 100, the control unit 100 commands the toner-transport screw 580 to replenish the toner T until the toner-detecting sensor 590 detects that the height of the toner T that is retained in the toner container 530 has reached the replenishment end level H2 (steps S212-S216). However, the processing flow of the height correction processing according to the foregoing exemplary embodiment of the invention is not limited to such an example. For example, the water-level correction processing according to the foregoing exemplary embodiment of the invention may be modified in such a manner that, after the idle rotations of the development roller 510, the detection of the toner-detecting sensor 590 as to whether the height of the toner T that is retained in the toner container 530 is at the replenishment end level H2 or not and the subsequent replenishment of the toner T are skipped (i.e., not performed). However, the height correction processing according to the foregoing exemplary embodiment of the invention is preferable to and advantageous over the variation example described above in that, because the control unit 100 commands the toner-transport screw 580 to replenish the toner T until the toner-detecting sensor 590 detects that the height of the toner T that is retained in the toner container 530 has reached the replenishment end level H2 if the toner-detecting sensor 590 detects that the water level of the toner T falls short of the replenishment end height H2 even after the development roller 510 has rotated in the high-speed mode in an idle manner without performing the development of a latent image under the command of the control unit 100, it is possible to correct the height of the toner T so as to ensure that the water level thereof is at the replenishment end height H2 even when the toner T is replenished by the predetermined amount.

In the toner-replenishment control processing according to the foregoing exemplary embodiment of the invention, as illustrated in FIG. 7, it is explained that the control unit 100 acquires information on the consumption amount of the toner T that is used by the development roller 510 for latent-image development. It is further explained therein that, if the control unit 100 judges that the consumption amount of the toner T has reached a "predetermined value" (e.g., threshold value) (step S102: Yes), the control unit 100 commands the toner-detecting sensor 590 to detect whether or not the water level of the toner T that is retained in the toner container 530 lies at the replenishment start level H1 at which the toner-transport screw 580 should start the replenishing of the toner T (step S104). It is further explained therein that the control unit 100 commands the toner-transport screw 580 to start the replenishment of the toner T if, as the result of such detection, it is judged that the water level of the toner T that is retained in the toner container 530 lies at the replenishment start level H1 at which the toner-transport screw 580 should start the replenishing of the toner T. However, the processing flow of the toner-replenishment control according to the foregoing exemplary embodiment of the invention is not limited to such an example. For example, the toner-replenishment control processing according to the foregoing exemplary embodiment of the invention may be modified in such a manner that the control unit 100 commands the toner-detecting sensor 590 to constantly/always detect whether or not the water level of the toner T that is retained in the toner container 530 lies at the replenishment start level H1 during the operation of the development unit 50Y. However, the toner-replenishment control processing according to the foregoing exemplary embodiment of the invention is preferable to and advantageous over the variation example described above in that it is possible to reduce the amount/consumption of power supplied to the toner-detecting sensor 590, which is achieved by operating the toner-detecting sensor 590 only when the control unit 100 judges that the consumption amount of the toner T has reached the predetermined threshold value.

Moreover, in the configuration of the printer 10 according to the foregoing exemplary embodiment of the invention, it is explained that the photosensitive member 20Y/20M/20C/20K is supported on the body thereof in a rotatable manner. It is further explained therein that the photosensitive member 20Y/20M/20C/20K rotates with a faster speed when the development roller 510 rotates in the high-speed mode for the development of a latent image, whereas the photosensitive member 20Y/20M/20C/20K rotates with a slower speed when the development roller 510 rotates in the low-speed mode for the development of a latent image. However, the configuration of the printer 10/ according to the foregoing exemplary embodiment of the invention is not limited to such an example. For example, the configuration of the printer 10 according to the foregoing exemplary embodiment of the invention may be modified in such a manner that the rotation speed of the photosensitive member 20Y/20M/20C/20K under the high-speed-mode rotation of the development roller 510 is the same as that under the low-speed-mode rotation thereof. That is, the toner-replenishment control according to the foregoing exemplary embodiment of the invention may be applied to a case where the rotation speeds of the photosensitive member 20Y/20M/20C/20K, the image fixation unit 90, and the like are constant under an assumption that the rotation speeds of the development roller 510 differ from each other (or one another) depending on predetermined speed modes.

The entire disclosure of Japanese Patent Application No. 2007-052857, filed Mar. 2, 2007 is expressly incorporated by reference herein.

What is claimed is:

1. An image formation apparatus comprising:

a containing section that contains a developer, the containing section having an opening;

a developer carrier that is exposed at the opening and carries a developer, the developer carrier being capable of rotating, the developer carrier rotating on the basis of either a first speed mode or a second speed mode so as to develop a latent image that is formed on an image carrier, the first speed mode having a faster speed of rotation of the developer carrier, the second speed mode having a slower speed of rotation of the developer carrier;

a replenishing member that replenishes a developer into the containing section;

a detecting member that detects whether the height of a developer that is contained in the containing section is at a replenishment start level at which replenishment performed by the replenishing member should be started or not and further detects whether the height of a developer that is contained in the containing section is at a replenishment end level at which replenishment performed by the replenishing member should be ended or not; and a controlling section that controls the replenishment of a developer that is performed by the replenishing member, the controlling section commanding the replenishing member to replenish a developer until the detecting member detects that the height of the developer that is contained in the containing section is at the replenishment end level if the detecting member detects that the height of the developer that is contained in the containing section is at the replenishment start level when the developer carrier that rotates on the basis of the first speed mode develops the latent image, whereas the controlling section commanding the replenishing member to replenish a developer by a predetermined amount if the detecting member detects that the height of the developer that is contained in the containing section is at the replenishment start level when the developer carrier that rotates on the basis of the second speed mode develops the latent image.

2. The image formation apparatus according to claim 1, wherein the controlling section commands the developer carrier to rotate in the first speed mode without performing the development of a latent image after the developer carrier rotating in the second speed mode has finished latent-image development processing.

3. The image formation apparatus according to claim 2, wherein, if the detecting member detects that the height of the developer falls short of the replenishment end level even after the developer carrier has rotated in the first speed mode without performing the development of a latent image under the command of the controlling section, the controlling section commands the replenishing member to replenish the developer until the detecting member detects that the height of the developer that is contained in the containing section has reached the replenishment end level.

4. The image formation apparatus according to claim 1, wherein the predetermined amount is smaller than the amount of the developer that is replenished by the replenishing member from the start of the replenishment till the end thereof, where the replenishment is started when the detecting member detects that the height of the developer that is contained in the containing section is at the replenishment start level after the remaining amount of the developer, that is contained in the containing section has decreased because the developer had been used, for developing a latent image, by the developer carrier rotating in the second speed mode, and the replenishment is ended when the detecting member detects that the height of the developer that is contained in the containing section is at the replenishment end level.

5. The image formation apparatus according to claim 1, wherein the controlling section acquires information on the consumption amount of the developer that is used by the developer carrier for latent-image development;

if the controlling section judges that the consumption amount of the developer has reached a predetermined value, the controlling section commands the detecting member to detect whether or not the height of the developer that is contained in the containing section lies at the replenishment start level at which the replenishing member should start the replenishing of the developer; and the controlling section commands the replenishing member to start the replenishment of the developer if, as the result of such detection, it is judged that the height of the developer that is contained in the containing section lies at the replenishment start level at which the replenishing member should start the replenishing of the developer.

6. The image formation apparatus according to claim 1, wherein the image carrier is provided in a rotatable manner; and the image carrier rotates with a faster speed when the developer carrier rotates in the first speed mode for the development of the latent image, whereas the image carrier rotates with a slower speed when the developer carrier rotates in the second speed mode for the development of the latent image.

7. An image formation system comprising:

a computer; and an image formation apparatus that can be connected to the computer, the image formation apparatus of the image formation system including:

a containing section that contains a developer, the containing section having an opening;

a developer carrier that is exposed at the opening and carries a developer, the developer carrier being capable of rotating, the developer carrier rotating on the basis of either a first speed mode or a second speed mode so as to develop a latent image that is formed on an image carrier, the first speed mode having a faster speed of rotation of the developer carrier, the second speed mode having a slower speed of rotation of the developer carrier;

a replenishing member that replenishes a developer into the containing section;

a detecting member that detects whether the height of a developer that is contained in the containing section is at a replenishment start level at which replenishment performed by the replenishing member should be started or not and further detects whether the height of a developer that is contained in the containing section is at a replenishment end level at which replenishment performed by the replenishing member should be ended or not; and a controlling section that controls the replenishment of a developer that is performed by the replenishing member, the controlling section commanding the replenishing member to replenish a developer until the detecting member detects that the height of the developer that is contained in the containing section is at the replenishment end level if the detecting member detects that the height of the developer that is contained in the containing section is at the replenishment start level when the developer carrier that rotates on the basis of the first speed mode develops the latent image, whereas the controlling section commanding the replenishing member to replenish a developer by a predetermined amount if the detecting member detects that the height of the developer that is contained in the containing section is at the replenishment start level when the developer carrier that rotates on the basis of the second speed mode develops the latent image.

* * * * *